US005787520A

United States Patent [19]

Dunbar

[11] Patent Number: 5,787,520

[45] Date of Patent: Aug. 4, 1998

[54] SHOWER CURTAIN SEALING KIT

[76] Inventor: James A. Dunbar, P.O. Box 200, Craig, Ak. 99921

[21] Appl. No.: 829,898

[22] Filed: Mar. 25, 1997

[51] Int. Cl.[6] ..... A47K 3/22

[52] U.S. Cl. ..... 4/609; 4/605

[58] Field of Search ..... 4/609, 605, 608, 4/558

[56] References Cited

U.S. PATENT DOCUMENTS 3,855,642 12/1974 Blitch .
3,984,880 10/1976 Schrameyer .
4,771,517 9/1988 Bonanno .
4,887,324 12/1989 Cairns ..... 4/609
4,944,050 7/1990 Shames et al. .

*Primary Examiner*—David J. Walczak
*Attorney, Agent, or Firm*—Terrance L. Siemens

[57] ABSTRACT

Two cooperating members for sealing a shower curtain to an associated shower stall. One member is stationary, and is permanently fixed to the shower stall. The other member attaches to the shower curtain, magnetically adhering to the stationary member, and has a handle for maneuvering. The stationary member is triangular, contacting and attaching to the sill of the bathtub and to a vertical wall of the stall at two faces, and presenting the third face to the handle member. The handle member has a flat surface for cooperating with the third face of the stationary member. The handle member is formed in two mating parts which close around the shower curtain.

1 Claim, 2 Drawing Sheets

SHOWER CURTAIN SEALING KIT

BACKGROUND OF THE INVENTION

1. Field of the Invention

The present invention relates to apparatus for sealing a shower curtain against gaps which may exist between the shower curtain and its associated shower stall. More particularly, the invention comprises a group of cooperating elements or a kit, part of which is installed to the curtain and part of which is installed to the stall. The two parts removably mate when placed in abutment, thereby holding the shower curtain firmly in contact with the stall and defeating potential gaps between the two.

2. Description of the Prior Art

It is a frequent source of annoyance that shower curtains fail to seal a shower stall against escape of water. This water is objectionable when collecting on the surrounding floor and threatens to become destructive if allowed to infiltrate past joints into the floor or walls.

There is a need for apparatus to engage a shower curtain and secure the same so as to seal a gap existing between the shower curtain and fixed elements of the shower stall. Splash guards which are able to adhere to shower curtains have been proposed in the prior art to defeat escaping water. Examples are seen in U.S. Pat. Nos. 4,771,517, issued to Vincent L. Bonanno on Sep. 20, 1988, and 4,944,050, issued to Sidney J. Shames et al. on Jul. 31, 1990. In each case, the subject splash guard engages the shower curtain in a manner different from that of the present invention, and also lacks a handle found in the present invention.

It is known to embed magnets within shower curtains so that the shower curtain will adhere to a magnetically responsive element, such as a porcelain coated iron bathtub. However, such attraction will not necessarily ensure that the shower curtain will be appropriately positioned to prevent gaps, since the shower curtain lacks a dam positioned and configured to cooperate with that element embedded in or associated with the shower curtain. Also, such shower curtains lack handles found in the present invention.

Splash guards which do not directly fasten to the shower curtain, and thus differ from the present invention, are seen in U.S. Pat. Nos. 3,855,642, issued to William E. Blitch on Dec. 24, 1974, 3,984,880, issued to Arnold F. Schrameyer on Oct. 12, 1976. These latter patents lack handles for grasping and maneuvering a shower curtain into anchorage with a stationary member fixed to a bathtub or other member of a shower stall.

None of the above inventions and patents, taken either singly or in combination, is seen to describe the instant invention as claimed.

SUMMARY OF THE INVENTION

The present invention provides two cooperating elements which together adhere a shower curtain to its associated shower stall. One element is a triangular dam which is permanently mounted at two faces to the corner of the shower stall formed by the sill of a bathtub and a vertical wall of the stall meeting the sill. The third face is exposed for receiving the second element.

The second element comprises a handle member which engages the shower curtain by sandwiched entrapment thereof. One layer of the sandwich incorporates a magnetic element which engages a corresponding magnetic element embedded within the triangular dam. The other layer of the sandwich has a handle for grasping and maneuvering the shower curtain into successful engagement of the triangular dam.

The second element is formed from two components which are joined by frictional engagement. Preferably, studs projecting from one of the two components penetrate and engage the other component. Optionally, these studs are threaded or grooved to accept nuts.

The triangular dam has more than nominal thickness. Therefore, the third face of the dam is sufficiently broad to engage a corresponding broad surface of the handle component along a plane rather than along a line. This relationship assures that solid magnetic connection between the dam and the handle component will ensue. Also, the third face is oriented for maximally convenient connection when maneuvering the handle member into engagement with the stationary member.

Accordingly, it is a principal object of the invention to provide apparatus for sealing gaps which may otherwise exist between a shower curtain and an associated shower stall.

It is another object of the invention to provide a first member for permanent mounting within the shower stall and a second member removably attached to the shower curtain.

It is a further object of the invention to enable manually removable adherence between the first and second members.

Still another object of the invention is to enable grasping and maneuvering of the shower curtain into a position assuring firm engagement with the member permanently mounted to the shower stall.

An additional object of the invention is to provide apparatus for entrapping the shower curtain within the second member.

Yet a further object of the invention is to provide a mating surface on the stationary member disposed at a convenient orientation for maneuvering the handle member into engagement therewith.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
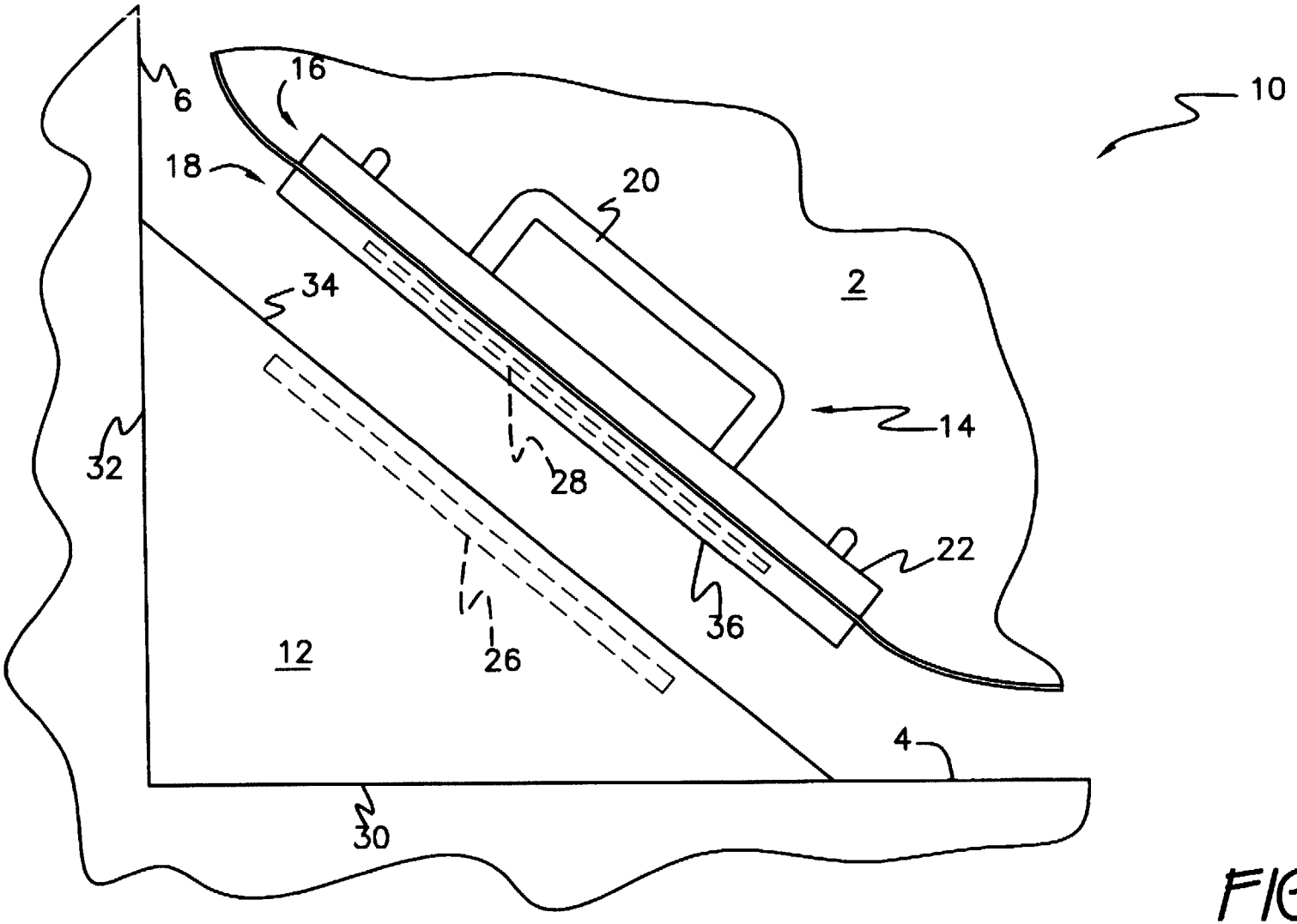
FIG. 1 is an environmental, side elevational view of the invention.

Turning now to FIG. 1 of the drawings, novel sealing apparatus 10 for sealing a shower curtain 2 to an associated shower stall having a bathtub sill 4 and a vertical wall 6 intersecting and perpendicular to bathtub still 4, is shown installed. Sealing apparatus 10 comprises a stationary member 12 for mounting permanently to the shower stall and a handle member 14 engaging shower curtain 2. Handle member 14 engages the shower curtain by sandwiching the same.

To this end, handle member 14 has a first section 16 and a second section 18. First section 16 has a handle 20 projecting upwardly from a first generally planar member 22. Second section 18 cooperates with first section 16, thereby providing attachment apparatus enabling sandwiched entrapment of shower curtain 2 between sections 16 and 18.

Handle member 14 has removable connection apparatus for releasably engaging stationary member 12. This arrangement releasably fastens shower curtain 2, which is secured to handle member 14, to stationary member 12. Connection is enabled by embedding a magnet 26 within stationary member 12 and a magnetically responsive member, such as a ferrous metal strip 28, within second section 18 of handle member 14.

Stationary member 12 is triangular, having three faces 30, 32, 34. Surfaces 30 and 32 are flat and arranged at a right angle to one another. This relationship enables triangular stationary member 12 to contact bathtub sill 4 and vertical wall 6 of the shower stall. Preferably, stationary member 12 is provided with an adhesive coating (not shown) disposed upon faces 30 and 32. If provided, this adhesive coating may be protected until installation by a removable liner (not shown). Alternatively, the user furnishes a suitable adhesive cement or an equivalent for permanently mounting stationary member 12 within the shower stall as depicted in FIG. 1.

Third face 34 enables removable engagement of handle member 14. Handle member 14 has a broad, smooth, flat contact surface 36 which cooperates in configuration with face 34 of stationary member 12. When placed in abutment, face 34 and contact surface 36 will leave little room for admitting water to pass therebetween. Adherence of their respective members 12 and 14 is maintained by magnetic attraction.

Face 34 is oriented away from faces 30 and 32, and in fact faces upwardly and away from both sill 4 and wall 6. This configuration enables ready alignment of handle member 14 with respect to stationary member 12 when a user maneuvers handle member 14 and shower curtain 2 into engagement with stationary member 12.

Figure 2:
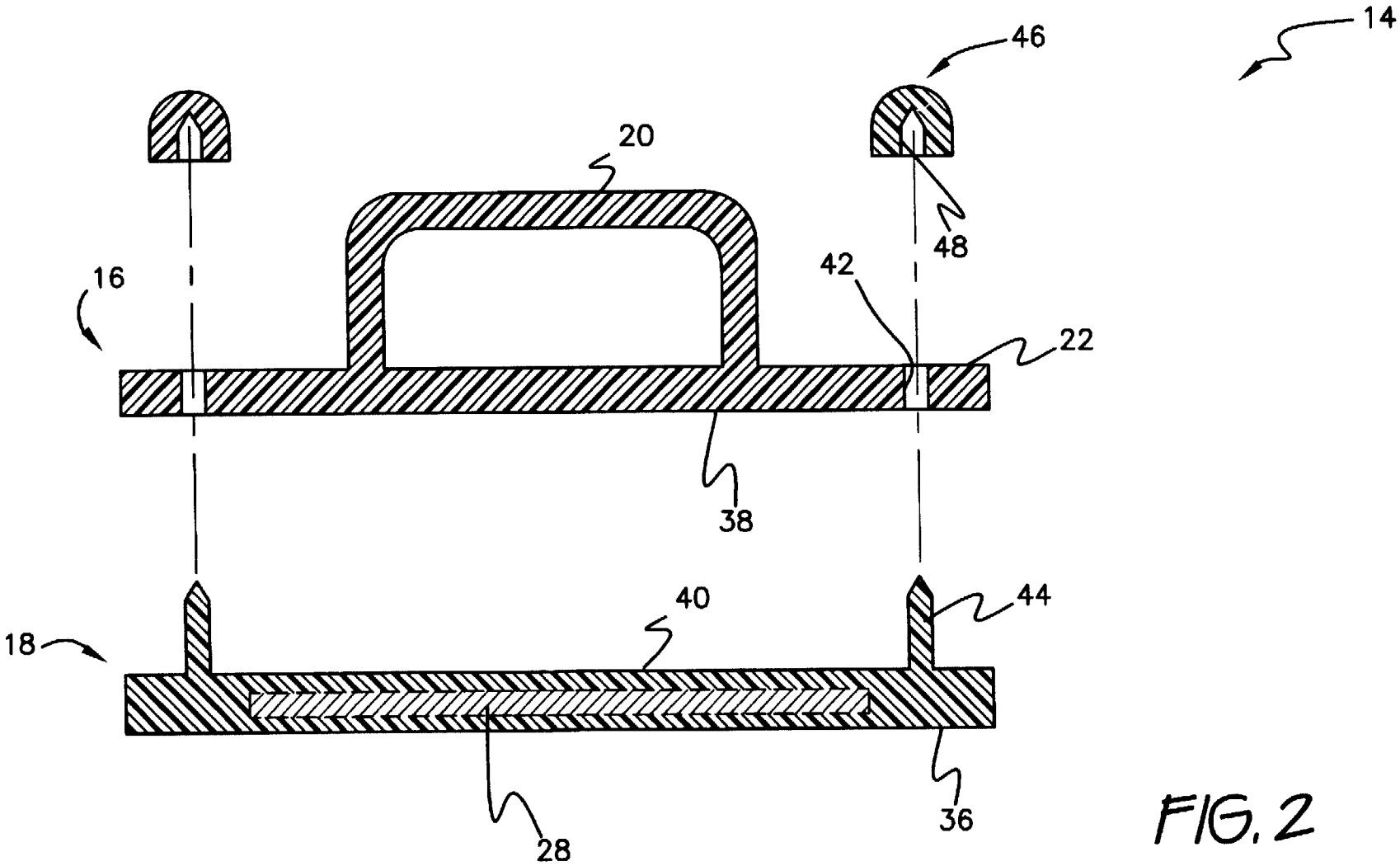
FIG. 2 is a side elevational view shown mostly in cross section.

FIG. 2 shows construction of handle member 14. First section 16 has a first mating surface 38. Second section 18 has a corresponding second mating surface 40 disposed to cooperate with first mating surface 38. Shower curtain 2 (see FIG. 1) may thus be entrapped between first and second mating surfaces 38 and 40.

First and second sections 16, 18 are frictionally fit to one another. First section 16 has bores 42 for receiving prongs 44 projecting upwardly from second section 18. Optionally, prongs 44 have ribs or threads (neither shown) for engaging nuts or caps 46. Caps 46 have bores 48 for receiving prongs 44.

When installing sealing apparatus 10, surfaces 38 and 40 of handle member 14 may fully contact shower curtain 2. Alternatively, shower curtain 2 may be positioned so as to be pinched between first and second sections 16 and 18 of handle member 14, but may not occupy the entire area corresponding to surfaces 38 and 40. Shower curtain 2 may thereby escape penetration by prongs 44 or their equivalent.

The present invention is susceptible to many modifications and variations which may be introduced by those of skill in the art without departing from the inventive concept. For example, prongs 44 may entirely penetrate caps 46. Caps 46 may be formed integrally with handle member 14. Prongs 44 and bores 42 may take other forms, such as snaps or still others (not shown), provided that first and second sections 16, 18 are provided with male and female mating structure.

It is not critical that second section 18 bear the male member of the male and female mating structure. Similarly, either stationary member 12 or handle member 14 may contain the active magnetic member, while the other contains the magnetically responsive member. If desired, both magnetically interacting members may be magnets. If this latter option is pursued, steps must be taken at the time of assembly to assure compatible polarity, so that shower curtain 2 does not become twisted when members 12 and 14 are magnetically adhered.

First and second sections 16, 18 of handle member 14 need not have common, coextensive edges, provided that there is sufficient mating surface for entrapping shower curtain 2 therebetween. Similarly, handle member 14 may overhang stationary member 12 at two sides, while stationary member 12 may extend beyond the bounds of handle member 14 at other sides.

It is to be understood that the present invention is not limited to the embodiments described above, but encompasses any and all embodiments within the scope of the following claims.

I claim:

1. A sealing apparatus for releasably attaching a shower curtain to an associated shower enclosure, where the shower enclosure includes a bathtub sill and a vertical wall, and where the vertical wall is perpendicular to and intersects the bathtub sill, said sealing apparatus comprising:

a handle member having a first handle member section and a second handle member section, where said first handle member section includes a handle portion and a generally planar first shower curtain retaining portion, and where said second handle member section includes a generally planar second shower curtain retaining portion and a magnetic attachment means, and where said first and said second generally planar shower curtain retaining portions have cooperating male/female attachment members designed to engage the shower curtain therebetween;

a stationary member adapted to cooperate with the bathtub sill and vertical wall, where said stationary member is triangular and has three outwardly directed faces, a first face adapted to cooperate with and seal the bathtub sill, a second face adapted to cooperate with and seal the vertical wall, and a third face for removably engaging said magnetic attachment means of said generally planar second shower curtain retaining portion of said handle member; whereby said stationary member is attached to the bathtub sill and the vertical wall and the shower curtain is engaged between said first and said second generally planar shower curtain retaining portions, said first and said second generally planar shower curtain retaining portions are held together by said cooperating male/female attachment members and said magnetic attachment means attaches said handle member to said stationary member to prevent water from inadvertently splashing out of the shower enclosure.

* * * * *